US005657690A

United States Patent [19]

Douville et al.

[11] Patent Number: 5,657,690

[45] Date of Patent: Aug. 19, 1997

[54] OFFSET PRINTING HEAD AND PRINTING MACHINE INCLUDING AT LEAST ONE SUCH PRINTING HEAD

[75] Inventors: Jean-Pierre Douville, Gagny; Jean-Louis Dubuit, Paris, both of France

[73] Assignee: Societe d'Exploitation des Machines Dubuit, Noisy le Grand, France

[21] Appl. No.: 580,483

[22] Filed: Dec. 29, 1995

[30] Foreign Application Priority Data

Jan. 13, 1995 [FR] France ..... 95 00354

[51] Int. Cl.[6] ..... B41L 13/04

[52] U.S. Cl. ..... 101/116; 101/36; 101/126

[58] Field of Search ..... 101/214, 216, 101/35–36, 114, 115, 116, 485, 126, 129, DIG. 36; 414/217, 225, 788.4

[56] References Cited

U.S. PATENT DOCUMENTS

| | | | |
|---|---|---|---|
| 3,633,505 | 1/1972 | Ferrari et al. . | |
| 3,827,356 | 8/1974 | Snow et al. | 101/35 |
| 5,165,340 | 11/1992 | Karlyn et al. . | |
| 5,313,882 | 5/1994 | Karlyn et al. | 101/126 |
| 5,456,169 | 10/1995 | Rohwetter et al. | 101/126 |
| 5,515,778 | 5/1996 | Boonen et al. | 101/35 |
| 5,520,107 | 5/1996 | Airoldi | 101/115 |

FOREIGN PATENT DOCUMENTS 0581378 2/1994 European Pat. Off. .

*Primary Examiner*—Eugene H. Eickholt
*Attorney, Agent, or Firm*—Young & Thompson

[57] ABSTRACT

An offset printing head includes, mounted to rotate parallel to each other and spaced from each other on a common carriage that is itself mounted to be mobile in translation on a frame, an inking roller and a blanket cylinder. As it moves to and fro, the carriage sweeps across a plate support which receives a plate and an object support which receives an object to be printed. The inking roller and/or the blanket cylinder are each driven by an individual drive system specific to it and independent of the movement of the carriage. Applications include printing machines combining an offset printing head with a silkscreen printing head.

24 Claims, 3 Drawing Sheets

OFFSET PRINTING HEAD AND PRINTING MACHINE INCLUDING AT LEAST ONE SUCH PRINTING HEAD

BACKGROUND OF THE INVENTION

1. Field of the Invention

The present invention concerns printing flat objects such as compact discs or computer diskettes in one or more colors and is more particularly concerned with the situation in which, to obtain a particularly fine quality of printing, the printing machine utilizes at least one offset printing head.

2. Description of the Prior Art

An offset printing head includes at least one inking roller and at least one blanket cylinder mounted to rotate parallel to each other on a common carriage that is mobile in translation on a frame. As it moves to and fro, the carriage sweeps across a plate support adapted to receive a plate and an object support adapted to support an object to be printed.

At present offset printing heads are in practise entirely mechanical and in particular rotation of the inking roller and the blanket cylinder are mechanically induced by the movement of the carriage, either because they are mounted as idler rollers on the carriage and are rotated purely because of their contact with the plate and, in the case of the blanket cylinder, with the object to be printed, or because they are positively rotated by a drive device of some kind, for example a rack and pinion device, fixed to the carriage.

The execution of these various movements is therefore highly rigid, and the same applies to the corresponding adjustments, to the detriment of flexibility of operation and use of the system.

To increase the thickness of the film of ink deposited onto the plate and thereby to improve the inking of the plate, two spaced parallel inking rollers are usually employed.

This increases the length of the carriage, however, to the detriment of the amount of floor space taken up by the printing machine and of the duration of its operating cycle, and therefore its productivity.

At the cost of some complexity, it is at present normally necessary to provide for relative vertical movement between the blanket cylinder and the object support in offset printing heads so that, after the object it carries is printed, the object support can be moved back without risk of interference with the blanket cylinder and therefore without risk of soiling the printed object, and so that a new object support carrying a new object to be printed can be offered up at the appropriate time and under the same conditions.

A general object of the present invention is an arrangement that avoids these drawbacks and has other advantages.

SUMMARY OF THE INVENTION

Offset printing head including, mounted to rotate parallel to each other and spaced from each other on a common carriage that is itself mounted to be mobile in translation on a frame, an inking roller and a blanket cylinder, said carriage, as it moves to and fro, sweeping across a plate support adapted to receive a plate and an object support adapted to receive an object to be printed, wherein said inking roller and/or said blanket cylinder is each driven by a respective individual drive system independent of the movement of said carriage.

With the inking roller and/or the blanket cylinder individually driven, it is advantageously possible to refine the rotation of the roller as required, the benefits of which are better operating conditions and easier adjustment of the system.

The inking roller and the blanket cylinder preferably have respective individual drive systems.

In the case of the inking roller, it is then possible, in accordance with a subsidiary feature of the invention, to use only one inking roller although the plate is inked twice, as previously, once during the forward stroke of the carriage and again during its return stroke.

To achieve this, the circular perimeter of the single inking roller used in a printing head in accordance with this invention has a circumference at least equal to twice that of the plate to be inked so that on the forward stroke of the carriage a first portion of this perimeter is in contact with the plate and on the return stroke of the carriage a second portion of the perimeter, separate from the first, is in contact with the plate, its individual drive system rotating it sufficiently between the two strokes for this second portion of the perimeter to be substituted for the first.

Other things being equal, the length and the travel of the carriage are advantageously short, as is therefore the operating cycle of the system.

In the case of the blanket cylinder, and in accordance with another subsidiary feature of the invention, the circular perimeter of the blanket cylinder preferably has a circumference equal to at least twice that of the blanket that it carries and is such that, on the forward stroke of the carriage, it offers up in vertical alignment with the object support the side opposite the blanket, so as to perform a "dry" pass over the object normally present on the object support, its individual drive system them rotating it sufficiently for the blanket to contact the object during the return stroke of the carriage, to print the object.

Because the blanket cylinder moves over the object to be printed without coming into contact with it during the forward stroke of the carriage, the corresponding dead time for the object support can advantageously be exploited to move the object support away from the printing head and to offer up to the latter a new object support carrying a new object to be printed.

This has the advantage that no relative vertical disengagement motion is required between the blanket cylinder and the object support to enable the necessary displacement of the latter after the object it carries is printed without risk of soiling it.

The respective individual drive systems of the inking roller and the blanket cylinder preferably include respective digital electric motors.

The linear movement of the carriage is preferably driven by a digital electric motor.

Thus the various movements in the offset printing head of the invention are advantageously digitized and this has the advantage that they can therefore be synchronized with very great precision.

This improves both control and flexibility of operation and use of the system as well as optimizing the operating cycle, with the overall benefits of improved print quality and increased productivity.

The features and advantages of the invention will emerge from the following description given by way of example with reference to the appended diagrammatic drawings.

DETAILED DESCRIPTION OF THE PREFERRED EMBODIMENTS

Figure 1:
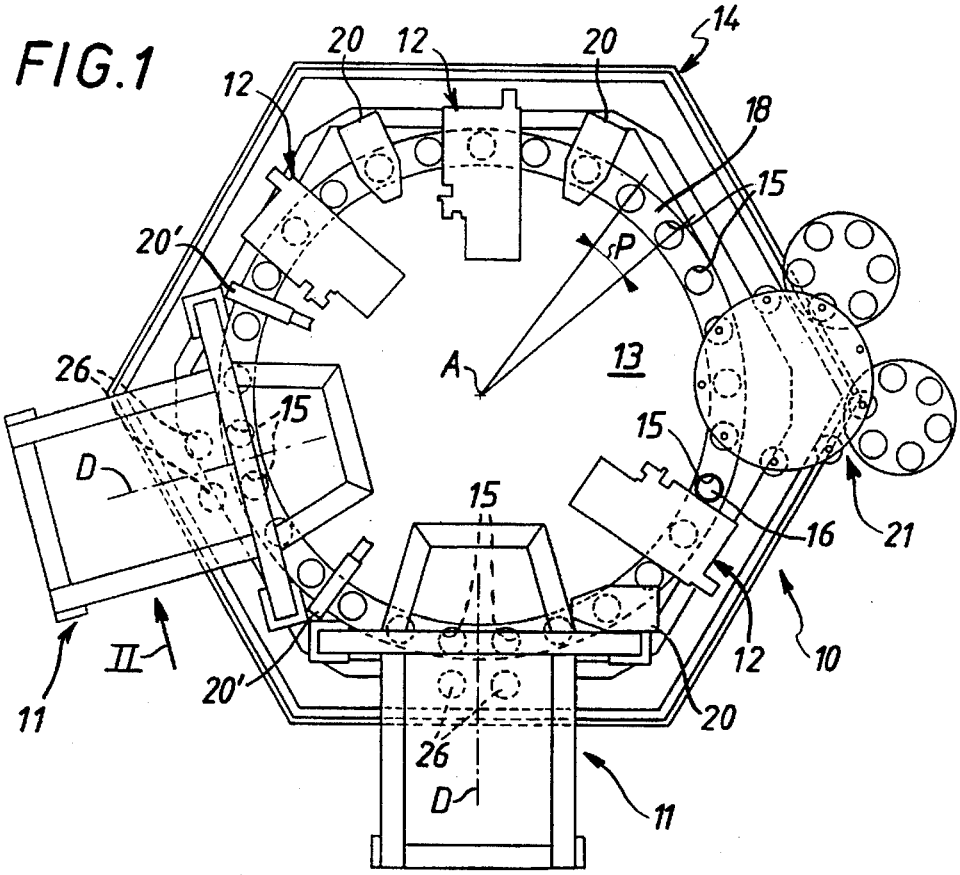
FIG. 1 is a plan view of a printing machine using an offset printing head in accordance with the invention.

The figures show, by way of example, the application of the invention to a printing machine 10 having at least one offset printing head 11 and at least one silkscreen printing head 12 to combine the fine printing that can be obtained with an offset printing head such as the head 11 and the ability to deposit large amounts of ink obtained with a silkscreen printing head such as the head 12.

In the embodiment shown the printing machine 10 includes a circular table 13 that rotates relative to a frame 14 about a vertical axis A perpendicular to the plane of the table which carries, near its periphery, a plurality of circumferentially spaced object supports 15 each adapted to receive an object 16 to be printed. The table 13 is rotated stepwise.

The object 16 to be printed are flat objects in practise.

They are compact discs, computer diskettes or similar objects, for example.

A single object 16 is shown in place in FIG. 1 by way of example.

In practise there is an odd number of object supports 15. In the embodiment shown they are part of a ring 18 attached to the table 13.

Two successive object supports 15 on the table 13 are spaced by an angular pitch P.

The offset printing head 11 and the silkscreen printing head 12 are circumferentially spaced around the table 13, vertically above the path of movement of the object supports 15.

Thus in the embodiment shown a plurality of printing heads 11, 12 is spaced circumferentially around the table 13 and includes at least one offset printing head 11 and at least one silkscreen printing head 12. The printing heads 11, 12 alternate with an equal number of drying ovens 20, 20'

In the embodiment shown there are two offset printing heads 11, three silkscreen printing heads 12 and five drying ovens 20 and 20', namely three drying ovens 20 that operate when the table 13 is stationary and two drying ovens 20' that operate when the station is in motion.

All the drying ovens 20 and 20' are of the ultra violet kind, for example.

A loading/offloading unit 21 and various quality control and/or operation control units are disposed around the table 13.

The above arrangements are well known in themselves and as they are not in themselves relevant to the present invention they are not described in more detail here.

Nor are the offset printing heads 11 described in more detail here.

Only their components necessary for an understanding of the invention are described.

In the manner that is known in itself each of the offset printing heads 11 includes an inking roller 24 and a blanket cylinder 25 mounted to rotate parallel to each other, at a distance from each other, on a common carriage 22 that itself is mobile in translation on a frame 23. During its to and fro movement, i.e. during the movement that it performs in each printing cycle, the carriage 22 sweeps across a plate support 26 adapted to receive a plate 27 and an object support 15 on which an object 16 to be printed is normally placed.

As shown in chain-dotted line in FIG. 1, the direction D of to and fro movement of the carriage 22 is a radial direction of the table 13 and the rotation axes of the inking roller 24 and the blanket cylinder 25 are transverse to this direction D of to and fro movement.

In the embodiments shown the carriage 22 services two plate supports 26 and two object supports 15 simultaneously and in parallel.

Figure 3:
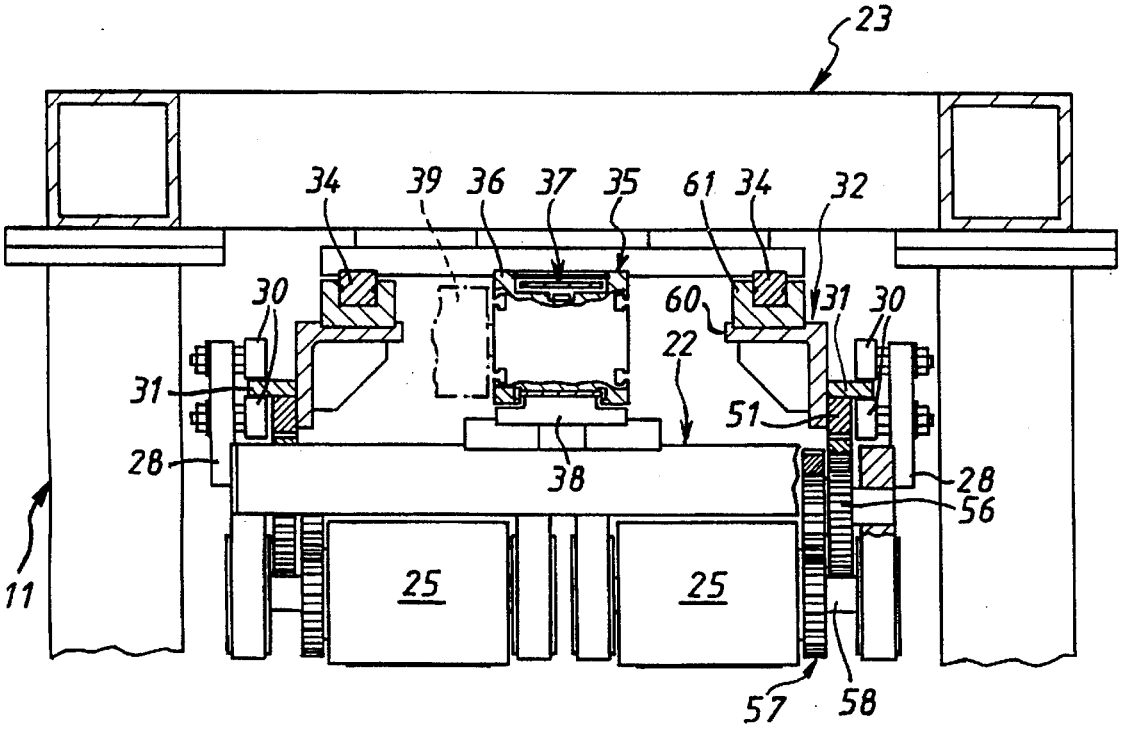
FIG. 3 is a partial cross-sectional view on the line III—III in FIG. 2 to a still larger scale.
Figure 4:
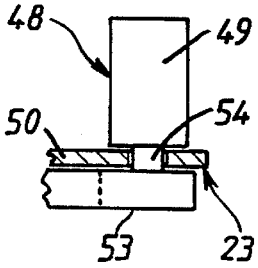
FIGS. 4 and 5 are respectively partial cross-sectional views on the lines IV—IV and V—V in FIG. 2.
Figure 5:
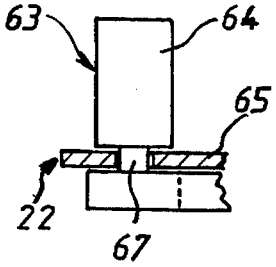

It is therefore equipped with two inking rollers 24 which in practise are coaxial with and spaced from each other and (see FIG. 3) two blanket cylinders 25 which are also in practise coaxial with and spaced from each other.

For simplicity the following description covers only one inking roller 24 and one blanket cylinder 25.

The carriage 22 is guided by two lateral flanges 28 on which are mounted rollers 30 through which it is engaged with two parallel rails 31.

In the embodiment shown in FIGS. 1 through 5 each of the rails 31 is part of an assembly 32 which is itself mobile in translation on the frame 23, being engaged to this end with a guide rail 34 carried by the frame.

The carriage 22 is driven by an integral rail guidance device 35 of the type marketed under the tradename "STAR", by the company AIME VIS A BILLES S.A., or "THK".

As an integral rail guidance device 35 of this kind is well known in itself and is not in itself relevant to the present invention it is not described in more detail here.

Suffice to say (see FIG. 3) that it includes an endless belt 37 running along a rail 36. A shoe 38 is fixed to the lower run of the belt. As shown in chain-dotted line in FIG. 3, the belt 37 is driven by a motor 39, in practise a digital electric motor.

As the person skilled in this art is well aware, the control of a digital electric motor 39 of this kind can be coded at will.

It is of the "brushless" type, for example.

The rail 36 is carried by the frame 23 and the carriage 22 is fixed to the shoe 38.

These provisions "digitize" the linear to and fro movement of the carriage 22.

The inking roller 24 is in practise to the rear of the blanket cylinder 25 with reference to the direction of movement of the carriage 22 towards the rotation axis A of the table 13.

In practise the carriage 22 moves between a retracted position (as shown in chain-dotted line in FIGS. 6A, 6F and 6G) in which the inking roller 24 comes tangentially into contact with a donor roller 40 and an advanced position (see FIG. 2) in which the blanket cylinder 25 lies beyond the object support 15 carrying the object 16 to be printed.

Figure 2:
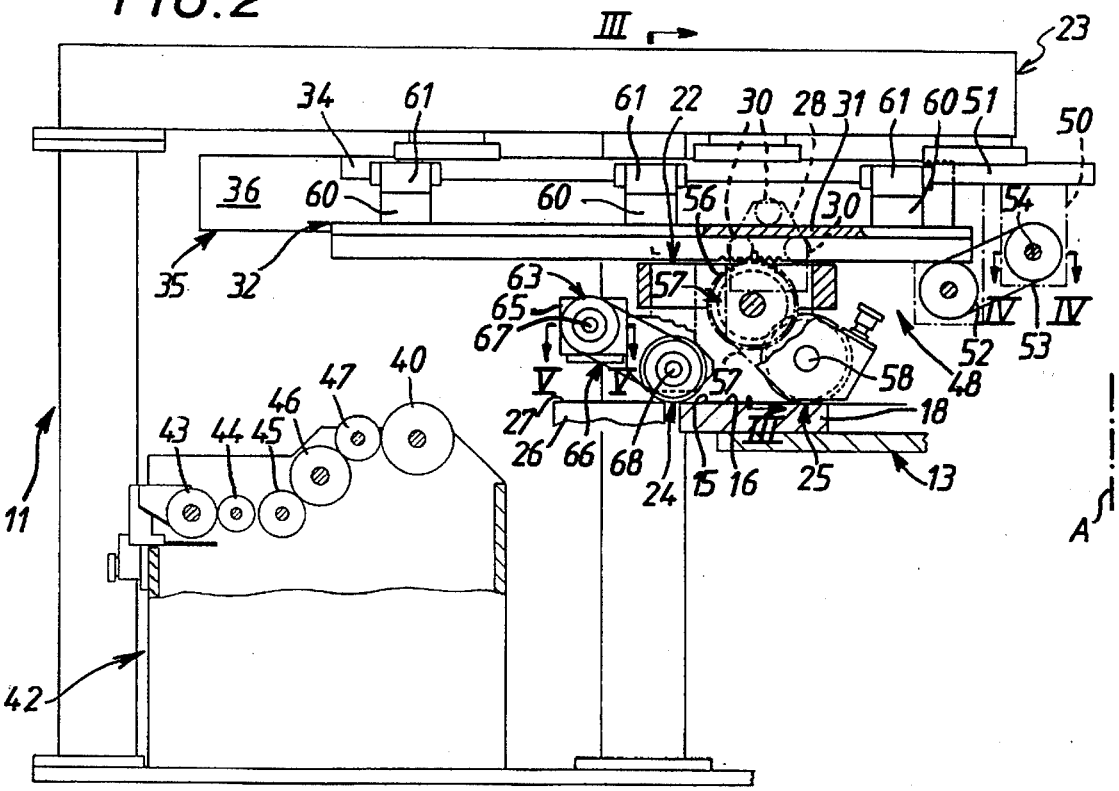
FIG. 2 is an elevation view of this offset printing head as seen in the direction of the arrow II in FIG. 1, partly cut away and to a larger scale.

As shown in FIG. 2, and in the manner that is known in itself, the donor roller 40 is part of an inking table 42 fixed relative to the frame 23 and which includes, in addition to the donor roller 40, for example, in succession from an inking roller 43, a first donor roller 44, a first distributor roller 45, a second donor roller 46 and a second distributor roller 47.

The various rollers 40, 43, 44, 45, 46 and 47 are rotatably mounted on the inking table 42 and the distributor rollers 45, 47 are additionally mounted thereon to be mobile in translation to and fro along their axis.

In accordance with the invention, each inking roller 24 and/or blanket cylinder 25 has a respective individual drive system independent of the motion of the carriage 22.

In the embodiments shown the blanket cylinder 25 has an individual drive system 48 including a digital electric motor 49 carried by the frame 23, to be more precise by a flange 50 attached to the frame 23.

The control of the digital electric motor 49 is of the "brushless" type, for example, like that of the digital electric motor 39.

As in the embodiments shown, the individual drive system 48 of the blanket cylinder 25 preferably includes a rack 51 slideably mounted on the frame 23 and meshing with a pinion 52 constrained by a transmission system 53 to rotate with the output shaft 54 of the digital electric motor 49 and with which meshes a pinion 56 with which the spindle 58 of the blanket cylinder 25 is constrained to rotate by a transmission system 57.

In the embodiments shown the transmission system 53 is of the belt and pulley type and the transmission system 57 is a gear train.

In the embodiment shown in FIGS. 1 through 5 the rack 51 is part of the mobile assembly 32, to which it is appropriately fastened.

The rack 51 is in practise on the bottom face of the rail 31 and the mobile assembly 32 is reduced to a plurality of angle-brackets 60 spaced along the rail 31, one flange carrying the rail 31 and the rack 51 and the other flange carrying a yoke 61 attaching them to the guide rail 34.

As shown in FIG. 6, and in the manner that is known in itself, the blanket cylinder 25 carries at its peperiphery a blanket 62 for transferring onto the object 16 to be printed ink deposited on the plate 27 by the inking roller 24.

In accordance with the invention, the circular perimeter of the blanket cylinder 25 has a circumference at least twice that of the blanket 62 that it carries.

In other words, the blanket 62 extends over at most half the periphery of the blanket cylinder 25.

In the embodiments shown, and in accordance with the invention, the inking roller 24 has an individual drive system 63 separate from the individual drive system 48 of the blanket cylinder 25 and including a digital electric motor 64 carried by the carriage 22, to be more precise by a flange 65 attached to the carriage 22.

In the embodiment shown there is in practise a transmission system 66, of the belt and pulley type, for example, between the output shaft 67 of the digital electric motor 64 and the spindle 68 of the inking roller 24.

Like that of the digital electric motors 39 and 49, the control of the digital electric motor 64 is of the "brushless" type, for example.

In accordance with the invention, only one inking roller 24 is associated with the blanket cylinder 25 and, conjointly, the circular perimeter of the inking roller 24 has a circumference at least twice the length of the plate 27 to be inked.

In accordance with the invention the plate 27 is flat and the plate support 26 is accordingly itself flat.

It will readily be understood that a flat plate 27 with the same orientation as the resulting printing advantageously facilitates any adjustment of its position on the plate support 26 that may be required.

Such adjustments of its position are easily carried out because everything can be seen clearly.

The plate support 26 is preferably mobile perpendicularly to the direction D of to and fro movement of the carriage 22 and to the rotation axes of the inking roller 24 and the blanket cylinder 25, under the control of a cell (not shown) sensing the presence or the absence of an object 16 on the object support 15.

The person skilled in the art is well aware of such provisions and for this reason they are not shown in the figures and are not described here.

As the result of the above provisions, and independently of the linear movement of the carriage 22, the rotation movements of the inking roller 24 and the blanket cylinder 25 of a printing head in accordance with the invention are each individually digitized.

Although they are independent of each other, the various linear and rotation movements are synchronized with each other, of course.

Consider the carriage 22 in the retracted position in which (see FIG. 6A) the inking roller 24 is tangentially in contact with the donor roller 40 of the inking table 42, at the time at which a new printing cycle of the offset printing head 11 begins.

Assume that the inking roller 24 deposited a film of ink on the plate 27 during the previous printing cycle.

Figure 6A:
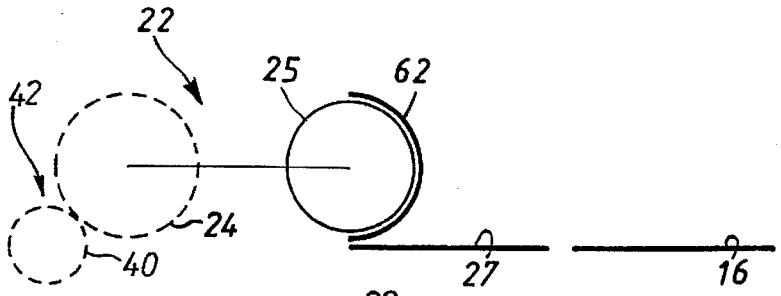
FIGS. 6A through 6G are schematic elevation views derived from the FIG. 2 elevation view and showing various successive phases in the operation of the offset printing head of the invention.

In the retracted position of the carriage 22, and as shown in FIG. 6A, the blanket cylinder 25 extends along the rear edge of the plate 27, on its upstream side.

By construction and, as will emerge below, under the control of the individual drive system 48 of the blanket cylinder 25, during the forward stroke of the carriage 22, shown by the arrow F1 in FIGS. 6B and 6C, the blanket cylinder 25 moves with the blanket 62 that it carries in contact with the plate 27.

The blanket cylinder 25 therefore picks off the plate 27 the film of ink previously deposited on it.

Figure 6B:
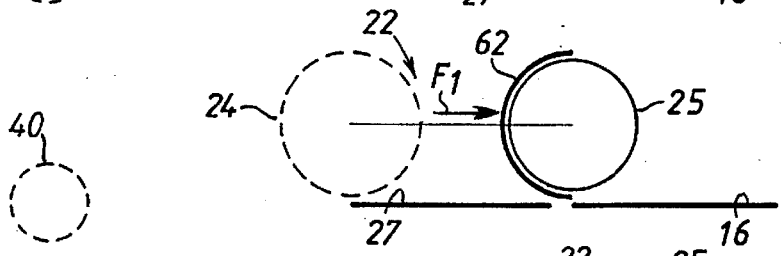
Figure 6C:
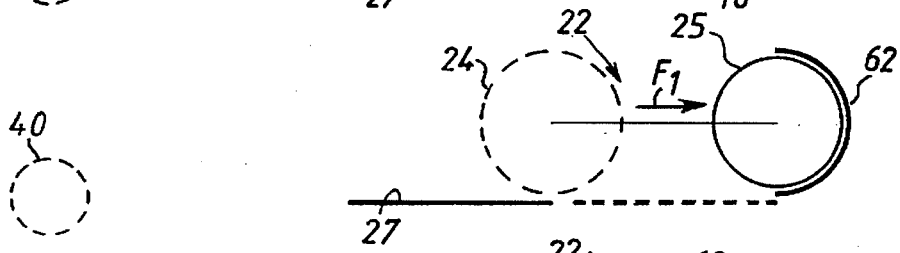

Because of the design adopted, the blanket cylinder 25 then offers up its side opposite the blanket 62 vertically above the object 16 normally present on the object support 15 concerned, as shown in FIGS. 6B and 6C, for a dry pass over the object 16 which in practise (see below) was printed during the previous printing cycle.

The expression "dry pass" used above refers to a pass in which the object 16 concerned does not come into contact with the blanket cylinder 25.

In practise this dry pass is obtained entirely by the effect of the difference in level at the periphery of the blanket cylinder 25 between the part of this roller carrying the blanket 62 and the diametrally opposite part on which there is no blanket, the difference in level resulting from the thickness of the blanket 62, which is in the order of 1 mm to 2 mm, for example.

As shown in chain-dotted line in FIG. 6C, advantage is taken of this dry pass of the blanket cylinder 25 over the object 16 to move the object 16 away from the offset printing head 11, by rotating the table 13 one step, and offer up a new object 16 to be printed vertically below the head 11.

As shown in FIGS. 6B and 6C, in conjunction with the dry pass of the blanket cylinder 25 over the object 16, a first portion of the periphery of the inking roller 24 carries out a first inking of the plate 27.

Figure 6D:
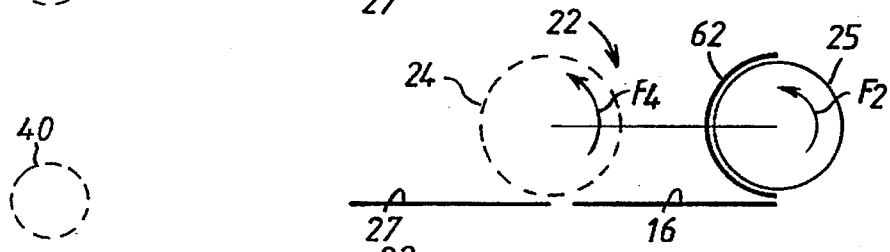
Figure 6E:
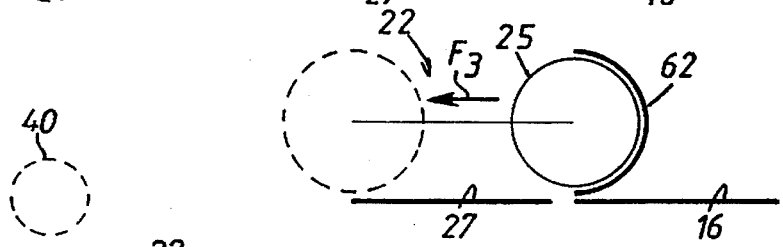
Figure 6F:
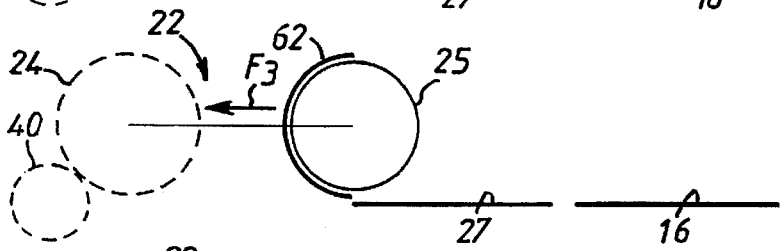

When the blanket cylinder 25 has travelled beyond the newly offered up object 16, as shown by the arrow F2 in FIG. 6D, its individual drive system 48 rotates it sufficiently for the blanket 62 it carries to move in contact with the object 16 to print the latter, as shown by an arrow F3 in FIGS. 6E and 6F.

The rotation upon itself of the blanket cylinder 25, referred to hereinafter for convenience as the resetting rotation, occurs when the carriage 22 stops, at the end of its forward stroke.

This resetting rotation is through about 180°.

Similarly, and as shown by the arrow F4 in FIG. 6D, the individual drive system 63 to the inking roller 24 applies a resetting rotation to the inking roller 24 prior to the return stroke of the carriage 22, and this resetting rotation is also through about 180°.

As a result, conjointly with the printing of the object 16 by the blanket cylinder 25, the second portion of the periphery of the inking roller 24 carries out a second inking of the plate 27 during the return stroke of the carriage 22.

At the end of this return stroke the carriage 22 is again in the retracted position and the inking roller 24 is again tangentially in contact with the donor roller 40 of the inking table 42.

In accordance with the invention the rotation speed of the digital electric motor 64 of the inking roller 24 is slaved to the rotation speed of the donor roller 40 so that its peripheral speed is the same as that as the donor roller 40 when it is in contact with the latter.

This has the advantage of preventing the formation of a bead of ink between the inking roller 24 and the donor roller 40.

The inking roller 24 preferably rotates through several complete revolutions while in contact with the donor roller 40.

For example, depending on the intensity and/or the uniformity with which the ink is to be distributed, the number of complete revolutions of the inking roller 24 on the donor roller 40 can be equal to 2, 3 or more.

This advantageous facility results from the fact that the drive system of the carriage 22 on which the inking roller 24 is mounted is independent of that of the inking table 42 of which the donor roller 40 is part.

Figure 6G:
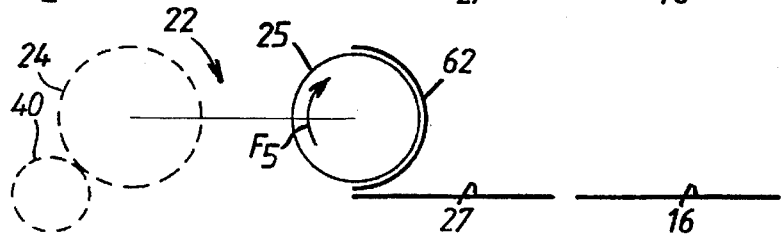

As shown by an arrow F5 in FIG. 6G, the individual drive system 48 of the blanket cylinder 25 imparts to the latter a further resetting rotation through about 180° and a new printing cycle can begin.

On each resetting rotation the rack 51 operates positively and always in the same direction on the blanket cylinder 25.

Accordingly, it always achieves rigorous angular indexing of the blanket cylinder 25, and therefore of the blanket 62 that it carries, relative to the plate 27 and to the object 16 to be printed, the benefit of which is accurate positioning of the printing on the object.

The rack 51 has the advantage of providing a very simple way to reduce the consequences of any slip in the digital electric motor 49 driving it.

On each pass of the inking roller 24 over the plate 27 the individual drive system 63 of the inking roller 24 controls its rotation so that it is suited to its movement along the plate 27.

The same applies to the blanket cylinder 25 as it passes over the plate 27 and over the object 16 to be printed.

If the cell senses that there is no object 16 on an object support 15, the plate support 26 is moved accordingly.

This advantageously avoids any unnecessary inking of the blanket 62 or even, if required, unnecessary inking of the plate 27.

The rotation step of the table 13 is preferably equal to twice the angular pitch P between two object supports 15 on the table 13.

In this way an object 16 can be systematically dried between two successive printings.

The distance between the two inking rollers 24, the two blanket cylinders 25 and the two plate supports 26 on the offset printing head 11 is of course equal to the angular pitch P between two object supports 15 on the table 13.

The pitch P is in practise a sub-multiple of the rotation step of the table 13, this sub-multiple being equal to 1 in the embodiment shown.

More generally, however, if the offset printing head 11 includes in parallel N inking rollers 24 and N blanket cylinders 25 to operate in parallel on an equal number of plate supports 26 and object supports 15, the rotation step of the table 13 is preferably equal to N times the angular pitch P.

The rotation speed of the various rollers 43, 44, 45, 46, 47 and 40 of the inking table 42 is preferably related electrically to the speed at which the carriage 22 moves on the frame 23.

Accordingly, if the operating speed of the system has to be increased, the inking roller 24 can rotate on the donor roller 40 as fast as necessary.

Figure 7:
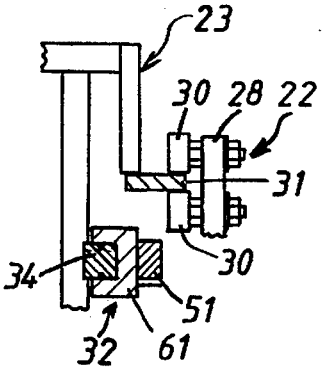
FIG. 7 is a partial cross-sectional view corresponding to part of FIG. 3 and relating to an alternative embodiment.

In the embodiment shown in FIG. 7 the rails 31 guiding the carriage 22 are attached directly to the frame 23, the rack 51 being directly engaged with one of the guide rails 34 through the yokes 61.

In other words, in this embodiment, the rack 51 is carried by the yokes 61 and the mobile assembly 32 of which it forms part is reduced to the combination of it and the yokes 61.

This advantageously reduces the mass of the mobile assembly 32.

Of course, the present invention is not limited to the embodiments described and shown, but encompasses any variant executions thereof.

There is claimed:

1. Offset printing head including, mounted to rotate parallel to each other and spaced from each other on a common carriage that is itself mounted to be mobile in translation on a frame, an inking roller and a blanket cylinder, said carriage, as it moves to and fro, sweeping across a plate support adapted to receive a plate and an object support adapted to receive an object to be printed, wherein said inking roller and/or said blanket cylinder is each driven by a respective individual drive system independent of the movement of said carriage.

2. Offset printing head according to claim 1 wherein said blanket cylinder is driven by an individual drive system.

3. Offset printing head according to claim 2 wherein said individual drive system of said blanket cylinder includes a digital electric motor.

4. Offset printing head according to claim 3 wherein said individual drive system of said blanket cylinder includes a rack slideably mounted on said frame and meshing with a pinion constrained to rotate with an output shaft of said digital electric motor and with which meshes another pinion, the other pinion being constrained to rotate with a spindle of said blanket cylinder.

5. Offset printing head according to claim 3 wherein said digital electric motor of said individual drive system of said blanket cylinder is carried by said frame.

6. Offset printing head according to claim 2 wherein the circular perimeter of said blanket cylinder has a circumference at least twice that of the blanket that it carries and is adapted, during a forward stroke of said carriage, to offer up in vertical alignment with an object normally present on said object support its side opposite said blanket for a dry pass over said object, its individual drive system then imparting a resetting rotation to it sufficient for said blanket to move in contact with said object during the return stroke of said carriage to print said object.

7. Offset printing head according to claim 6 wherein said resetting rotation of said blanket cylinder occurs when said carriage stops at the end of its forward stroke.

8. Offset printing head according to claim 6 wherein said resetting rotation of said blanket cylinder is through about 180°.

9. Offset printing head according to claim 1 wherein the circular perimeter of said inking roller has a circumference at least twice the length of said plate to be inked so that during a forward stroke of said carriage a first portion of its perimeter moves in contact with said plate and during a return stroke of said carriage a second portion of said perimeter different from said first portion moves in contact with said plate.

10. Offset printing head according to claim 1 wherein said inking roller is driven by an individual drive system.

11. Offset printing head according to claim 10 wherein said individual drive system of said inking roller includes a digital electric motor.

12. Offset printing head according to claim 11 wherein said digital electric motor of said individual drive system of said inking roller is carried by said carriage.

13. Offset printing head according to claim 11 wherein, said inking roller coming tangentially into contact with a donor roller which is rotatably mounted on an inking table fixed relative to said frame, the rotation speed of said digital electric motor of its individual drive system is slaved to the rotation speed of said donor roller so that its peripheral speed is the same as that of said donor roller where it is in contact therewith.

14. Offset printing head according to claim 1 wherein, said inking roller coming tangentially into contact with a donor roller fixed relative to said frame, it rotates through more than one complete revolution while it is in contact with said donor roller.

15. Offset printing head according to claim 1 wherein, for use with a flat plate, said plate support is flat.

16. Offset printing head according to claim 1 wherein said plate support is mobile perpendicularly to the direction of to and fro movement of said carriage and to the rotation axes of said inking roller and said blanket cylinder under the control of a cell sensing the presence or the absence of an object on said object support.

17. Offset printing head according to claim 1 wherein, said inking roller coming tangentially into contact with a donor roller that is part of an inking table fixed relative to said frame, the rotation speed of various rollers of said inking table is electrically related to the speed of displacement of said carriage on said frame.

18. Offset printing head according to claim 1 wherein said carriage is equipped with two inking rollers operating in parallel and with two blanket cylinders also operating in parallel and operates in parallel on two plate supports and on two object supports.

19. A printing machine comprising an offset printing head including, mounted to rotate parallel to each other and spaced from each other on a common carriage that is itself mounted to be mobile in translation on a frame, an inking roller and a blanket cylinder, said carriage, as it moves to and fro, sweeping across a plate support adapted to receive a plate and an object support adapted to receive an object to be printed, wherein said inking roller and/or said blanket cylinder is each driven by a respective individual drive system independent of the movement of said carriage.

20. Offset printing head according to claim 19 wherein said carriage is equipped with two inking rollers operating in parallel and with two blanket cylinders also operating in parallel and operates in parallel on two plate supports and on two object supports.

21. Printing machine according to claim 20 further comprising a table carrying a plurality of equi-angularly spaced object supports, rotatably mounted relative to a frame and adapted to be rotated stepwise, wherein the distance between said two inking rollers of said offset printing head, its two blanket cylinders and its two plate supports is equal to the angular pitch between two successive object supports on said table and said angular pitch is a sub-multiple of the rotation step of said table.

22. Printing machine according to claim 21 wherein, said offset printing head including in parallel N inking rollers and N blanket cylinders, for operation in parallel on an equal number of plate supports and of object supports, the rotation step of said table is equal to N times said angular pitch.

23. Printing machine according to claim 19 wherein at least one silkscreen printing head is associated with said offset printing head.

24. Printing machine according to claim 23 comprising an equal number of drying ovens alternating with said printing heads.

* * * * *